US009343878B2

(12) United States Patent
Kawano et al.

(10) Patent No.: US 9,343,878 B2
(45) Date of Patent: May 17, 2016

(54) MANUFACTURING METHOD OF MAIN METAL FITTING FOR SPARK PLUG AND MANUFACTURING METHOD OF SPARK PLUG

(71) Applicant: NGK SPARK PLUG CO., LTD., Nagoya (JP)

(72) Inventors: Hajime Kawano, Komaki (JP); Koji Kamikawa, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 191 days.

(21) Appl. No.: 14/238,386

(22) PCT Filed: Oct. 26, 2012

(86) PCT No.: PCT/JP2012/006871

§ 371 (c)(1),
(2) Date: Feb. 11, 2014

(87) PCT Pub. No.: WO2013/065269

PCT Pub. Date: May 10, 2013

(65) Prior Publication Data

US 2014/0194026 A1 Jul. 10, 2014

(30) Foreign Application Priority Data

Oct. 31, 2011 (JP) ..... 2011-238192

(51) Int. Cl.
*H01T 21/02* (2006.01)

(52) U.S. Cl.
CPC ..... *H01T 21/02* (2013.01)

(58) Field of Classification Search
USPC ..... 445/7; 313/141–143; 72/208
See application file for complete search history.

(56) References Cited

U.S. PATENT DOCUMENTS

| | | | | |
|---|---|---|---|---|
| 5,088,311 | A | 2/1992 | Inoue | |
| 2008/0203882 | A1 | 8/2008 | Kobayashi et al. | |
| 2010/0275869 | A1* | 11/2010 | Musasa | C22C 1/0466 123/169 EL |
| 2011/0183573 | A1* | 7/2011 | Ozeki | B21H 3/04 445/7 |
| 2011/0298353 | A1* | 12/2011 | Nakamura | H01T 13/36 313/145 |

FOREIGN PATENT DOCUMENTS

| | | | |
|---|---|---|---|
| JP | 03-90244 | A | 4/1991 |
| JP | 2005-238243 | A | 9/2005 |
| JP | 2008-210681 | A | 9/2008 |
| JP | 2013-094797 | A | 5/2013 |

OTHER PUBLICATIONS

International Search Report mailed Dec. 18, 2012 for the corresponding PCT Application No. PCT/JP2012/006871.

* cited by examiner

*Primary Examiner* — Nimeshkumar Patel
*Assistant Examiner* — Brenitra M Lee
(74) *Attorney, Agent, or Firm* — Leason Ellis LLP

(57) ABSTRACT

A metallic shell extends in the direction of an axial line and has a threaded portion on its outer circumferential surface for threading engagement with a mounting hole of a combustion apparatus. A process of manufacturing the metallic shell includes a step of forming a metallic shell tubular intermediate having the first tubular portion and the second tubular portion and a rolling step of forming the threaded portion on the metallic shell tubular intermediate. In the rolling step, a bearing member is inserted into the metallic shell tubular intermediate for nipping the metallic shell tubular intermediate in cooperation with working surfaces of the rolling dies, and rolling is performed simultaneously on at least the first tubular portion and the second tubular portion.

9 Claims, 14 Drawing Sheets

(a)

(b)

MANUFACTURING METHOD OF MAIN METAL FITTING FOR SPARK PLUG AND MANUFACTURING METHOD OF SPARK PLUG

CROSS-REFERENCE TO RELATED PATENT APPLICATIONS

This application is a U.S. National Phase application under 35 U.S.C. §371 of International Patent Application No. PCT/JP2012/006871, filed Oct. 26, 2012, and claims the benefit of Japanese Patent Application No. 2011-238192, filed on Oct. 31, 2011, all of which are incorporated by reference in their entirety herein. The International application was published in Japanese on May 10, 2013 as International Publication No. WO/2013/065269 under PCT Article 21(2).

FIELD OF THE INVENTION

The present invention relates to a method of manufacturing an ignition plug (spark plug) for use in an internal combustion engine or the like and to a method of manufacturing a metallic shell (main metal fitting) for use in the ignition plug.

BACKGROUND OF THE INVENTION

An ignition plug for use in combustion apparatus such as an internal combustion engine includes, for example, a center electrode extending in the direction of an axial line, an insulator provided externally of the outer circumference of the center electrode, and a cylindrical metallic shell attached externally to the insulator. Also, a ground electrode is joined to a forward end portion of the metallic shell, and a gap (spark discharge gap) is formed between the center electrode and the ground electrode for generating spark discharge. Additionally, the metallic shell has, on its inner circumferential surface, an elongated protrusion protruding radially inward and adapted to allow an outer circumferential surface of the insulator to be seated thereon and has, on its outer circumferential surface, a threaded portion to be threadingly engaged with a mounting hole of the combustion apparatus.

Meanwhile, the metallic shell is formed generally through extrusion and cutting work. Specifically, a columnar metallic shell intermediate formed of a predetermined metal material is placed in a tubular die; then, the metallic shell intermediate is deformed under pressure at its forward and rearward sides by means of predetermined jigs so as to form holes at the forward and rearward sides, respectively, of the metallic shell intermediate. Then, by use of a plurality of jigs, the formed holes are deformed under pressure so as to increase stepwise in depth and diameter; finally, the opposite holes of the metallic shell intermediate are connected so as to communicate with each other. At this time, an annular protrusion which is to become the elongated protrusion is formed on the inner circumferential surface of the metallic shell intermediate. Next, cutting work, etc., are performed on, for example, that portion of the internal circumferential surface of the metallic shell intermediate which is located forward of the protrusion, so as to adjust the shape of the metallic shell intermediate, thereby yielding a metallic shell tubular intermediate. Finally, rolling is performed on an outer circumferential surface of the metallic shell tubular intermediate so as to form the threaded portion, thereby yielding the metallic shell (refer to, for example, Japanese Patent No. 4210611).

Problem to be Solved by the Invention

Incidentally, eccentricity (offset or inclination of axis) may arise between the center axis of a tubular portion (first tubular portion) located at a forward end portion of the metallic shell tubular intermediate and the center axis of a tubular portion (second tubular portion; for example, a tubular portion located rearward of the elongated protrusion) located at an axial position different from that of the first tubular portion for, for example, the following reason: while a forward portion of the inner circumferential surface of the metallic shell is formed through cutting work, a rearward portion is formed through extrusion (i.e., different manufacturing apparatus are used for forming the forward hole and the rearward hole, respectively); or inclination of a jig used in extrusion. If such eccentricity arises, in attachment of the insulator to the metallic shell, positional offset may arise between the center axis of a forward end portion of the insulator and the center axis of a forward end portion of the metallic shell, and, in turn, the radial distance between the forward end portion of the metallic shell and a forward end portion of the center electrode may locally become excessively small, thereby causing an abnormal spark between the center electrode and the metallic shell, which would result in the occurrence of a defect such as misfire.

Particularly, in an ignition plug in which the metallic shell has a relatively small diameter, and thus, the radial distance between a forward end portion of the center electrode and a forward end portion of the metallic shell is relatively small, in order to prevent misfire, etc., the center axis of the forward end portion of the metallic shell and the center axis of the forward end portion of the center electrode must be accurately aligned with each other. However, if, as mentioned above, eccentricity arises between the first tubular portion and the second tubular portion, and the eccentricity is relatively large, great difficulty will be encountered in accurately aligning with each other the center axis of the forward end portion of the metallic shell and the center axis of the forward portion of the center electrode.

Thus, in order to reduce eccentricity between the first tubular portion and the second tubular portion, performing additional working on the metallic shell is conceived; however, this may incur an increase in manufacturing cost.

The present invention has been conceived in view of the above circumstances, and an object of the invention is to provide a method of manufacturing a metallic shell for an ignition plug in which eccentricity between the center axis of a first tubular portion and the center axis of a second tubular portion can be effectively reduced without involvement of an increase in manufacturing cost, and a method of manufacturing an ignition plug.

SUMMARY OF THE INVENTION

Means for Solving the Problem

Configurations suitable for achieving the above object will next be described in itemized form. When needed, actions and effects peculiar to the configurations will be described additionally.

Configuration 1. A method of manufacturing a metallic shell for an ignition plug of the present configuration is a method of manufacturing a metallic shell for an ignition plug (hereinafter, may be referred to merely as the "metallic shell") assuming a tubular form, extending in the direction of an axial line, and having a threaded portion on its outer circumferential surface for threading engagement with a mounting hole of a combustion apparatus, the method comprising:

a metallic shell tubular intermediate forming step of forming a metallic shell tubular intermediate which is a metallic shell intermediate having a tubular portion and is to become the metallic shell for an ignition plug, and a rolling step of forming the threaded portion by performing rolling on the metallic shell tubular intermediate by use of rolling dies. The method is characterized in that the metallic shell tubular intermediate forming step comprises:

a first tubular portion forming step of forming a first tubular portion at an end portion of the metallic shell intermediate, and a second tubular portion forming step of forming a second tubular portion at at least a portion of that region of the metallic shell intermediate which differs from the first tubular portion; and in the rolling step, in a condition in which a bearing member is inserted into the metallic shell tubular intermediate for nipping the metallic shell tubular intermediate in cooperation with working surfaces of the rolling dies, rolling is performed simultaneously on at least the first tubular portion and the second tubular portion such that the radial offset after the rolling step between a center axis of the first tubular portion and a center axis of the second tubular portion becomes smaller than the radial offset before the rolling step between the center axis of the first tubular portion and the center axis of the second tubular portion.

Configuration 2. A method of manufacturing a metallic shell for an ignition plug of the present configuration is characterized in that, in configuration 1 mentioned above, the bearing member assumes a rodlike form and has a first component having a shape along an inner circumferential surface of the first tubular portion, and a second component having a shape along an inner circumferential surface of the second tubular portion.

Configuration 3. A method of manufacturing a metallic shell for an ignition plug of the present configuration is characterized in that, in configuration 1 or 2 mentioned above, the metallic shell tubular intermediate has, between the first tubular portion and the second tubular portion, a portion having an inside diameter smaller than those of the first tubular portion and the second tubular portion.

Configuration 4. A method of manufacturing a metallic shell for an ignition plug of the present configuration is characterized in that, in any one of configurations 1 to 3 mentioned above, in the rolling step, a diametral difference between an inside diameter of the metallic shell tubular intermediate and an outside diameter of the bearing member is 0.8 mm or less in a radial cross section of the first tubular portion and in a radial cross section of the second tubular portion of the metallic shell tubular intermediate into which the bearing member is inserted.

Configuration 5. A method of manufacturing a metallic shell for an ignition plug of the present configuration is characterized in that, in any one of configurations 1 to 4 mentioned above, the threaded portion has a thread diameter of M12 or less.

Configuration 6. A method of manufacturing a metallic shell for an ignition plug of the present configuration is characterized in that, in any one of configurations 1 to 5 mentioned above, the metallic shell for an ignition plug is such that its length along the direction of the axial line is greater than its outside diameter.

Configuration 7. A method of manufacturing a metallic shell for an ignition plug of the present configuration is characterized in that, in any one of configurations 1 to 6 mentioned above, the metallic shell for an ignition plug has a seat portion protruding radially outward from its outer circumferential surface, and a length along the axial line from a forward end of the metallic shell to the seat portion of the metallic shell for an ignition plug is 20 mm or more.

Configuration 8. A method of manufacturing a metallic shell for an ignition plug of the present configuration is characterized in that, in any one of configurations 1 to 7 mentioned above, the bearing member is freely rotatable such that its center axis serves as an axis of rotation.

Configuration 9. A method of manufacturing a metallic shell for an ignition plug of the present configuration is characterized by comprising a method of manufacturing a metallic shell for an ignition plug according to any one of configurations 1 to 8.

Configuration 10. A method of manufacturing a metallic shell for an ignition plug of the present configuration is characterized in that, in configuration 9 mentioned above, the ignition plug comprises a tubular insulator disposed along an inner circumference of the metallic shell for the ignition plug, a center electrode disposed along an inner circumference of the insulator, and a ground electrode disposed at a forward end portion of the metallic shell for the ignition plug and forming a gap in cooperation with a forward end portion of the center electrode, and has a dimension of the gap of 0.4 mm or more.

According to configuration 1 mentioned above, in a condition in which the bearing member is inserted into the metallic shell tubular intermediate having the first tubular portion and the second tubular portion, rolling is performed simultaneously on at least these two tubular portions. Thus, in the rolling step, as a result of the outer circumferential surface of the metallic shell tubular intermediate being pressed by the rolling dies, particularly, a thick portion of the metallic shell tubular intermediate is deformed in a crushed manner while being nipped between the bearing member and the rolling dies. Accordingly, the inclinations of the inner circumferential surfaces of the first and second tubular portions can be rectified, and correction can be made such that the center axis of the first tubular portion (its inner circumferential surface) and the center axis of the second tubular portion (its inner circumferential surface) coincide with the center axis of the bearing member. As a result, as compared with a condition before the rolling step, the radial offset between the center axis of the first tubular portion and the center axis of the second tubular portion can be effectively reduced.

Also, without need to employ additional working, rolling to be generally performed for forming the threaded portion is utilized for reducing eccentricity between the center axis of the first tubular portion and the center axis of the second tubular portion, whereby an increase in manufacturing cost can be restrained.

According to configuration 2 mentioned above, the bearing member has the first component having a shape along the inner circumferential surface of the first tubular portion, and the second component having a shape along the inner circumferential surface of the second tubular portion. Therefore, in the rolling step, both of the first and second tubular portions can be more reliably corrected. As a result, eccentricity between the center axis of the first tubular portion and the center axis of the second tubular portion can be further reduced.

In the case where the metallic shell tubular intermediate is to have, between the first and second tubular portions, a portion having an inside diameter smaller than those of the first and second tubular portions, difficulty is encountered in forming the two tubular portions from a side toward one end of the metallic shell intermediate; thus, the first tubular portion may be formed from a side toward one end, and the second tubular portion may be formed from a side toward the other end. However, in this case, eccentricity between the two tubular portions is likely to become relatively large.

In this connection, according to configuration 3 mentioned above, the metallic shell tubular intermediate has, between the first and second tubular portions, the portion having an inside diameter smaller than those of the two tubular portions; therefore, an increase in eccentricity between the two tubular portion is of concern. However, through employment of configurations 1, etc., mentioned above, eccentricity between the two tubular portions can be rendered sufficiently small. In other words, configurations 1, etc., are particularly useful in the case where the metallic shell tubular intermediate is to have, between the first and second tubular portions, a portion having an inside diameter smaller than those of the first and second tubular portions.

According to configuration 4 mentioned above, the diametral difference between the inside diameter of the metallic shell tubular intermediate and the outside diameter of the bearing member is 0.8 mm or less in a radial cross section of the first tubular portion and in a radial cross section of the second tubular portion. Therefore, in the rolling step, the metallic shell tubular intermediate is more reliably nipped between the bearing member and the rolling dies, so that the metallic shell tubular intermediate can be more reliably deformed. As a result, eccentricity between the two tubular portions can be further reliably reduced.

In the case where the threaded portion has a small thread diameter, as mentioned above, the radial distance between a forward end portion of the center electrode and a forward end portion of the metallic shell becomes relatively small. Therefore, in order to prevent abnormal discharge, the center axis of the forward end portion of the metallic shell and the center axis of the forward end portion of the center electrode must be accurately aligned with each other. In order to implement this alignment, in the metallic shell tubular intermediate, the center axis of the first tubular portion and the center axis of the second tubular portion must be accurately aligned with each other.

In this connection, employment of configurations 1, etc., mentioned above can more reliably provide the metallic shell having a small eccentricity between the two tubular portions. In other words, similar to configuration 5 mentioned above, configurations 1, etc., mentioned above are particularly useful in manufacturing the metallic shell having a small thread diameter of the threaded portion of M12 or less and required to have accurate alignment between the center axis of the first tubular portion and the center axis of the second tubular portion.

The metallic shell in configuration 6 mentioned above; specifically, the metallic shell whose length along the axial line is greater than its outside diameter, is apt to increase in eccentricity between its forward end portion and a forward end portion of the insulator attached thereto.

In this connection, employment of configurations 1, etc., mentioned above can more reliably provide the metallic shell having a small eccentricity between the two tubular portions and, in turn, can sufficiently reduce eccentricity between a forward end portion of the metallic shell and a forward end portion of the insulator attached to the metallic shell. In other words, configurations 1, etc., are particularly useful in manufacturing the metallic shell whose length along the axial line is greater than its outside diameter.

The metallic shell having a relatively large length along the axial line from its forward end to its seat portion (so-called screw reach) is apt to increase in eccentricity between its forward end portion and a forward end portion of the insulator attached thereto.

In this connection, employment of configurations 1, etc., mentioned above can more reliably provide the metallic shell having a small eccentricity between the two tubular portions and, in turn, can sufficiently reduce eccentricity between a forward end portion of the metallic shell and a forward end portion of the insulator attached to the metallic shell. In other words, configurations 1, etc., are particularly useful in manufacturing an elongated metallic shell having a screw reach of 20 mm or more as in the above-described configuration 7.

According to configuration 8 mentioned above, the bearing member is freely rotatable such that its center axis serves as an axis of rotation, so that in the rolling step, the bearing member is rotatable together with the metallic shell tubular intermediate. Therefore, in the rolling step, friction force generated between the metallic shell tubular intermediate and the bearing member can be reduced to the greatest possible extent, and, in turn, there can be accelerated deformation of the metallic shell tubular intermediate resulting from nipping between the bearing member and the rolling dies. As a result, the radial offset between the center axis of the first tubular portion and the center axis of the second tubular portion can be quite effectively reduced.

As in the case of configuration 9 mentioned above, the technical ideas of configurations 1, etc., may be applied to the method of manufacturing an ignition plug. In this case, in a manufactured ignition plug, eccentricity between a forward end portion of the insulator and a forward end portion of the metallic shell can be more reliably reduced.

In an ignition plug having a relatively large gap between the center electrode and the ground electrode and thus requiring a relatively large voltage for generating spark discharge across the gap, generation of even a little eccentricity between the center axis of a forward end portion of the metallic shell and the center axis of a forward end portion of the center electrode may cause generation of abnormal discharge between the center electrode and the metallic shell.

Employment of configurations 1, etc., mentioned above can more reliably provide the metallic shell having a small eccentricity between the two tubular portions and, in turn, can sufficiently reduce eccentricity between the center axis of a forward end portion of the metallic shell and the center axis of a forward end portion of the center electrode in a condition in which the insulator is attached to the metallic shell. In other words, configurations 1, etc., mentioned above are particularly useful in manufacturing an ignition plug which has a large dimension of the gap of 0.4 mm or more and is thus of greater concern with regard to generation of abnormal discharge resulting from eccentricity between the center electrode of a forward end portion of the metallic shell and the center axis of a forward end portion of the center electrode.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Figure 1:
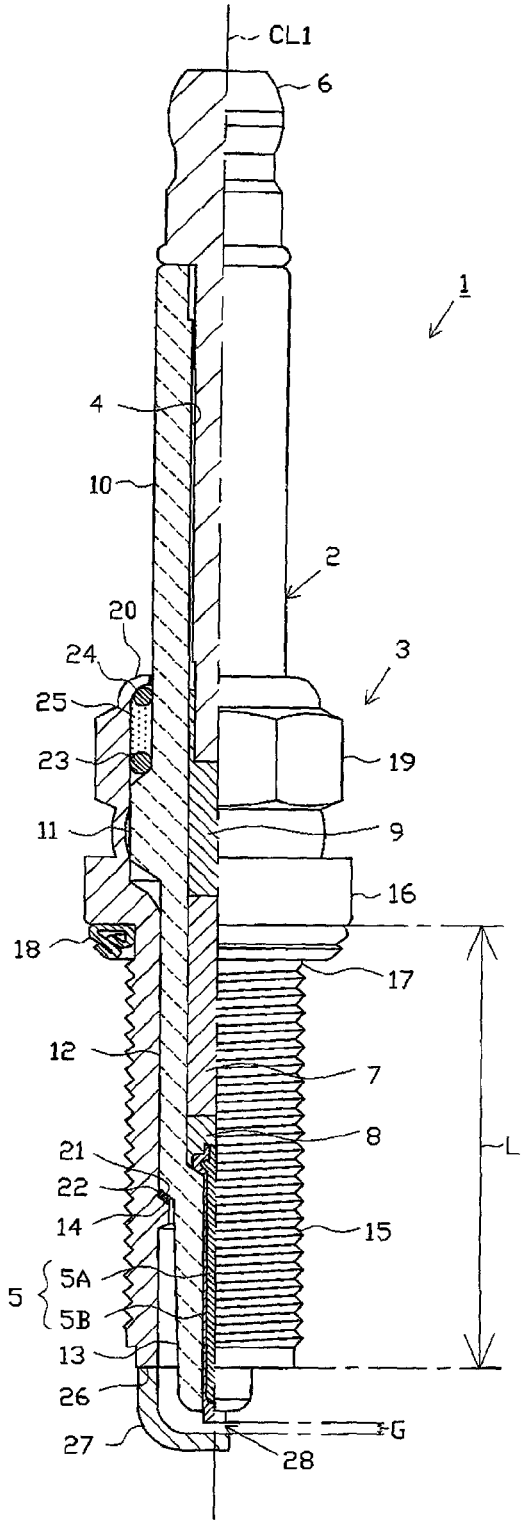
FIG. 1 is a partially cutaway front view showing the configuration of an ignition plug.

An embodiment of the present invention will next be described with reference to the drawings. FIG. 1 is a partially cutaway front view showing an ignition plug 1. In FIG. 1, the direction of an axial line CL1 of the ignition plug 1 is referred to as the vertical direction. In the following description, the lower side of the ignition plug 1 in FIG. 1 is referred to as the forward side of the ignition plug 1, and the upper side as the rear side.

The ignition plug 1 includes a ceramic insulator 2, which is the tubular insulator in the present invention, and a tubular metallic shell for an ignition plug (hereinafter, referred to as the "metallic shell) 3, which holds the ceramic insulator 2 therein.

The ceramic insulator 2 is, as well known, formed from alumina or the like by firing and, as viewed externally, includes a rear trunk portion 10 formed at its rear side; a large-diameter portion 11 located forward of the rear trunk portion 10 and protruding radially outward; an intermediate trunk portion 12 located forward of the large-diameter portion 11 and being smaller in diameter than the large-diameter portion 11; and a leg portion 13 located forward of the intermediate trunk portion 12 and being smaller in diameter than the intermediate trunk portion 12. Additionally, the large-diameter portion 11, the intermediate trunk portion 12, and most of the leg portion 13 of the ceramic insulator 2 are accommodated within the metallic shell 3. A tapered, stepped portion 14 is formed at a connection portion between the intermediate trunk portion 12 and the leg portion 13, and the ceramic insulator 2 is seated on the metallic shell 3 at the stepped portion 14.

Furthermore, the ceramic insulator 2 has an axial hole 4 extending therethrough along the axial line CL1, and a center electrode 5 is fixedly inserted into a forward end portion of the axial hole 4. The center electrode 5 includes an inner layer 5A formed of copper or a copper alloy and an outer layer 5B formed of a Ni (nickel) alloy which contains nickel as a main component. The center electrode 5 assumes a rodlike (circular columnar) shape as a whole, and its forward end portion protrudes from the forward end of the ceramic insulator 2.

Additionally, an electrode terminal 6 is fixedly inserted into the rear side of the axial hole 4 in such a condition as to protrude from the rear end of the ceramic insulator 2.

Furthermore, a circular columnar resistor 7 is disposed within the axial hole 4 between the center electrode 5 and the electrode terminal 6. Opposite end portions of the resistor 7 are electrically connected to the center electrode 5 and the electrode terminal 6 via electrically conductive glass seal layers 8 and 9, respectively.

Additionally, the metallic shell 3 is formed into a tubular shape from a low-carbon steel (e.g., the carbon content is 0.5% by mass or less) or a like metal and has, on its outer circumferential surface, a threaded portion (externally threaded portion) 15 adapted to attach the ignition plug 1 to a combustion apparatus such as an internal combustion engine or a fuel cell reformer. Also, the metallic shell 3 has a seat portion 16 located rearward of the threaded portion 15 and protruding radially outward, and a ring-like gasket 18 is fitted to a screw neck 17 at the rear end of the threaded portion 15. Furthermore, the metallic shell 3 has, near the rear end thereof, a tool engagement portion 19 having a hexagonal cross section and allowing a tool such as a wrench to be engaged therewith in attaching the metallic shell 3 to a combustion apparatus. Also, the metallic shell 3 has a crimped portion 20 provided at a rear end portion thereof and bent radially inward.

In the present embodiment, in order to reduce the diameter of the ignition plug 1 and elongate the ignition plug 1, the metallic shell 3 is reduced in diameter and elongated. Thus, the threaded portion 15 has a thread diameter of M12 or less (in the present embodiment, M10 or less), and a length L along the axial line CL1 from the forward end of the seat portion 16 to the forward end of the metallic shell 3 (so-called screw reach) is 20 mm or more. Additionally, the metallic shell 3 is such that its length along the axial line CL1 is greater than its outside diameter. As a result of reduction of the diameter of the metallic shell 3, the distance along a direction orthogonal to the axial line CL1 between the inner circumference of the forward end of the metallic shell 3 and a forward end portion of the ceramic insulator 2 is relatively small (e.g., 1.0 mm or less).

Also, the metallic shell 3 has, on its inner circumferential surface, an elongated protrusion 21 protruding radially inward. The ceramic insulator 2 is inserted forward into the metallic shell 3 from the rear end of the metallic shell 3, and, in a state in which its stepped portion 14 butts' against the elongated protrusion 21 of the metallic shell 3, a rear-end opening portion of the metallic shell 3 is crimped radially inward; i.e., the crimped portion 20 is formed, whereby the ceramic insulator 2 is fixed to the metallic shell 3. An annular sheet packing 22 intervenes between the stepped portion 14 and the elongated protrusion 21. This retains airtightness of a combustion chamber and prevents outward leakage of fuel gas entering a clearance between the leg portion 13 of the ceramic insulator 2 and the inner circumferential surface of the metallic shell 3, the clearance being exposed to the combustion chamber.

Furthermore, in order to ensure airtightness which is established by crimping, annular ring members 23 and 24 intervene between the metallic shell 3 and the ceramic insulator 2 in a region near the rear end of the metallic shell 3, and a space between the ring members 23 and 24 is filled with a powder of talc 25. That is, the metallic shell 3 holds the ceramic insulator 2 via the sheet packing 22, the ring members 23 and 24, and the talc 25.

Also, a ground electrode 27 is joined to a forward end portion 26 of the metallic shell 3 and is configured to be bent substantially at its intermediate portion such that a side surface of its distal end portion faces a forward end portion of the center electrode 5. A spark discharge gap 28, which is the gap in the present invention, is formed between the forward end portion of the center electrode 5 and the distal end portion of the ground electrode 27, and spark discharge is performed across the spark discharge gap 28 in a direction substantially along the axial line CL1. In the present embodiment, a dimension G of the gap 28 (the shortest distance between the center electrode 5 and the ground electrode 27) assumes a relatively large value of 0.4 mm to 2.0 mm (e.g., 1.1 mm).

Next will be described a method of manufacturing the thus-configured ignition plug 1.

Figure 2:
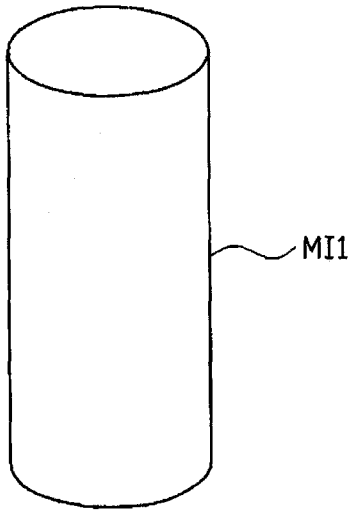
FIG. 2 is a perspective view showing the configuration of a metallic shell intermediate.

First, the metallic shell 3 is formed beforehand. Specifically, as shown in FIG. 2, there is prepared a circular columnar metallic shell intermediate MI1 formed of, for example, iron-based material, such as S17C or S25C, or stainless steel. In a metallic shell tubular intermediate forming step, cold extrusion is performed stepwise on the metallic shell intermediate MI1 by use of a plurality of dies.

Figure 3:
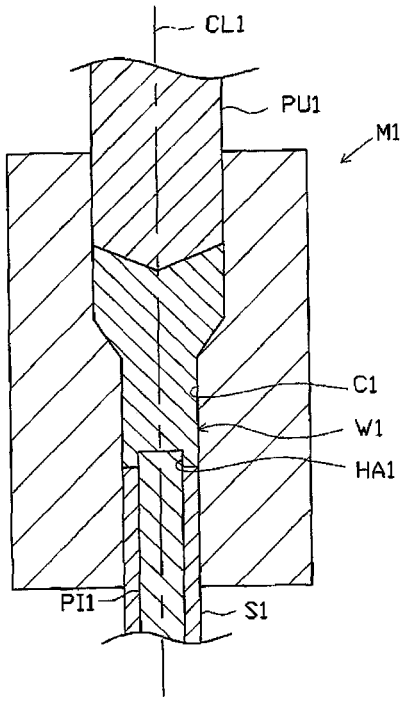
FIG. 3 is a sectional view showing one stage in a metallic shell tubular intermediate forming step.

More specifically, first, by use of a first die M1, etc., shown in FIG. 3, cold extrusion is performed on the metallic shell intermediate MI1. The first die M1 has a cavity C1 extending in the direction of the axial line CL1 and having a large diameter at the rear side and a small diameter at the forward side. The metallic shell intermediate MI1 is inserted into the cavity C1, and a tubular sleeve S1 and a pin PI1, which is inserted into the sleeve S1 with its distal end portion protruding rearward from an end surface of the sleeve S1 located on a side toward the cavity C1, are disposed at the forward side of the cavity C1. Then, a punch PU1 whose outside diameter is substantially identical to the diameter of a large-diameter portion of the cavity C1 is inserted into the cavity C1 from the rear side of the cavity C1 and extrudes the metallic shell intermediate MI1 forward. This procedure yields a first workpiece W1 which has a small-diameter forward portion having a hole HA1 at its forward end portion.

Figure 4:
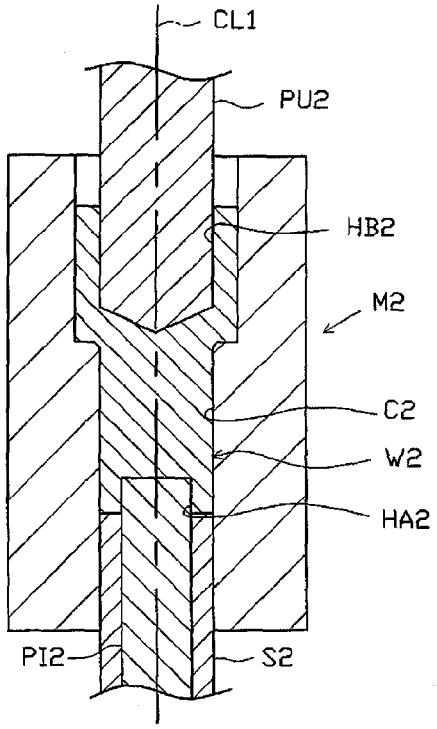
FIG. 4 is a sectional view showing another stage in the metallic shell tubular intermediate forming step.

Next, by use of a second die M2 shown in FIG. 4, cold extrusion is performed on the first workpiece W1. Specifically, the second die M2 has a cavity C2 having a large diameter at the rear side and a small diameter at the forward side. The first workpiece W1 is inserted into the cavity C2 from the rear side, and a tubular sleeve S2 and a pin PI2, which is inserted into the sleeve S2 with its distal end portion protruding rearward from an end surface of the sleeve S2 located on a side toward the cavity C2, are disposed at the forward side of the cavity C2. Then, a punch PU2 whose outside diameter is smaller than the inside diameter of a large-diameter portion of the cavity C2 is inserted into the cavity C2 from the rear side of the cavity C2. This procedure extrudes the first workpiece W1, yielding a second workpiece W2 which has a hole HA2 at its forward side and a hole HB2 at its rear side.

Figure 5:
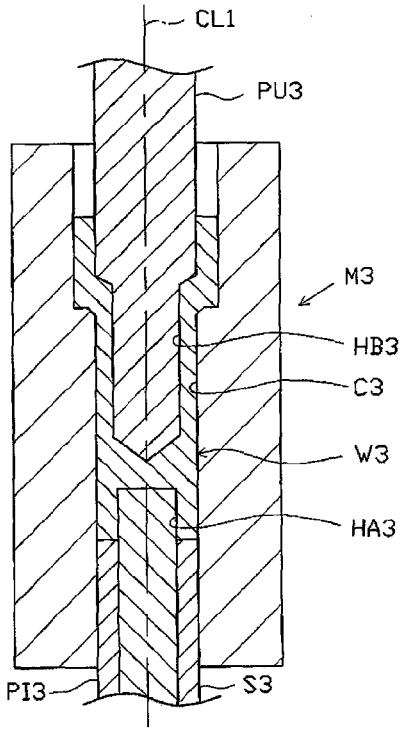
FIG. 5 is a sectional view showing a further stage in the metallic shell tubular intermediate forming step.

Next, by use of a third die M3 shown in FIG. 5, cold extrusion is performed on the second workpiece W2. Specifically, the third die M3 has a cavity C3 having a large diameter at the rear side and a small diameter at the forward side. The second workpiece W2 is inserted into the cavity C3 from the rear side, and a tubular sleeve S3 and a pin PI3, whose distal end portion protrudes rearward from the sleeve S3, are disposed at the forward side of the cavity C3. Then, a punch PU3 whose outside diameter is smaller than the inside diameter of a large-diameter portion of the cavity C3 and which has a step at its outer circumference is inserted into the cavity C3 from the rear side of the cavity C3. This procedure extrudes the second workpiece W2, yielding a third workpiece W3 which has a hole HA3 at its forward side and a hole HB3 at its rear side.

Figure 6:
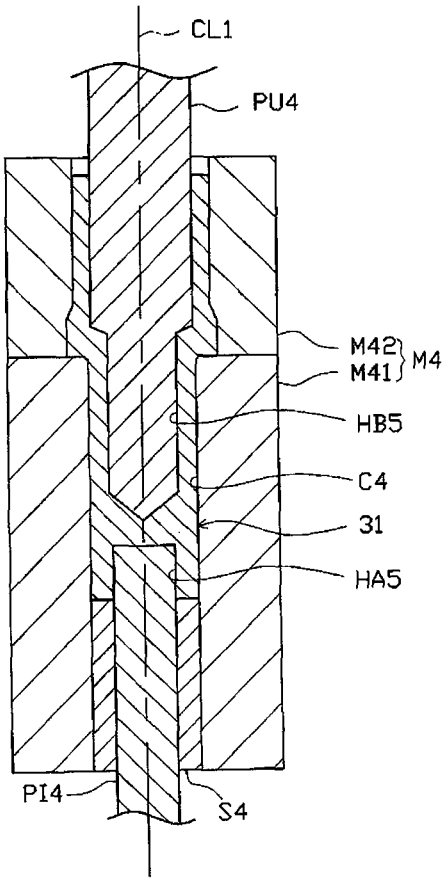
FIG. 6 is a sectional view showing a still further stage in the metallic shell tubular intermediate forming step.
Figure 7:
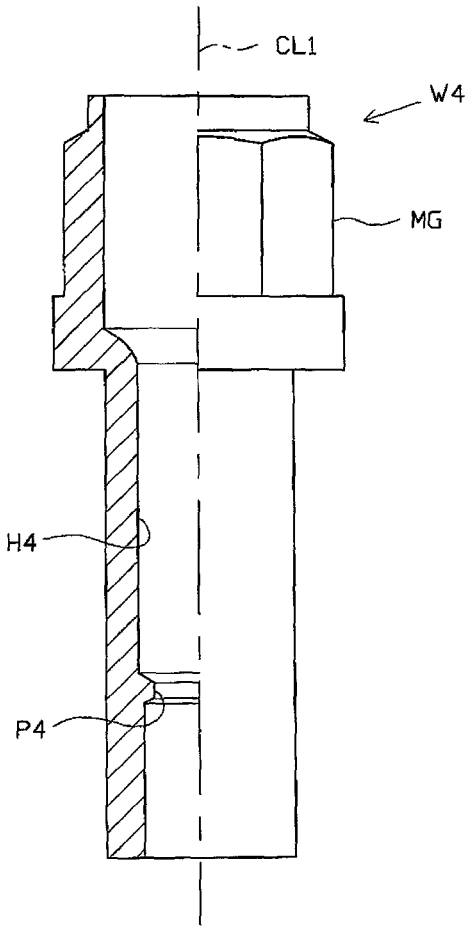
FIG. 7 is a partially cutaway front view showing the configuration of a fourth workpiece.

Next, by use of a fourth die M4 shown in FIG. 6, cold extrusion is performed on the third workpiece W3. The fourth die M4 is coaxially composed of a tubular forward die M41 and a tubular rear die M42 and has a cavity C4 extending in the direction of the axial line CL1. An inner circumferential portion of the rear die M42 has a large diameter at the forward side and a small diameter at the rear side. The inner circumferential surface of the large-diameter portion is formed into a cylindrical shape corresponding to the shape of the seat portion 16. At least a forward end portion of the inner circumferential surface of the small-diameter portion has a shape corresponding to the tool engagement portion 19. Returning back to the description of the manufacturing method, the third workpiece W3 is inserted into the cavity C4 from the rear side, and a sleeve S4 and a pin PI4, whose distal end portion protrudes rearward from the sleeve S4, are disposed at the forward side of the cavity C4. Then, a punch PU4 having a step at its outer circumference is inserted into the cavity C4 from the rear side of the cavity C4 so as to press the outer circumferential surface of the third workpiece W3 against the inner circumferential surface of the fourth die M4. By this procedure, as shown in FIG. 7, there is yielded a fourth workpiece W4 which has a polygonal columnar portion MG having the same cross-sectional shape as that of the tool engagement portion 19, and a through hole H4 formed through establishment of communication between the holes HAS and HB5 and extending in the direction of the axial line CL1. The fourth workpiece W4 has an annular protrusion P4 (which is to become the elongated protrusion 21) centered at the axial line CL1 and protruding radially inward from its inner circumferential surface.

Figure 8:
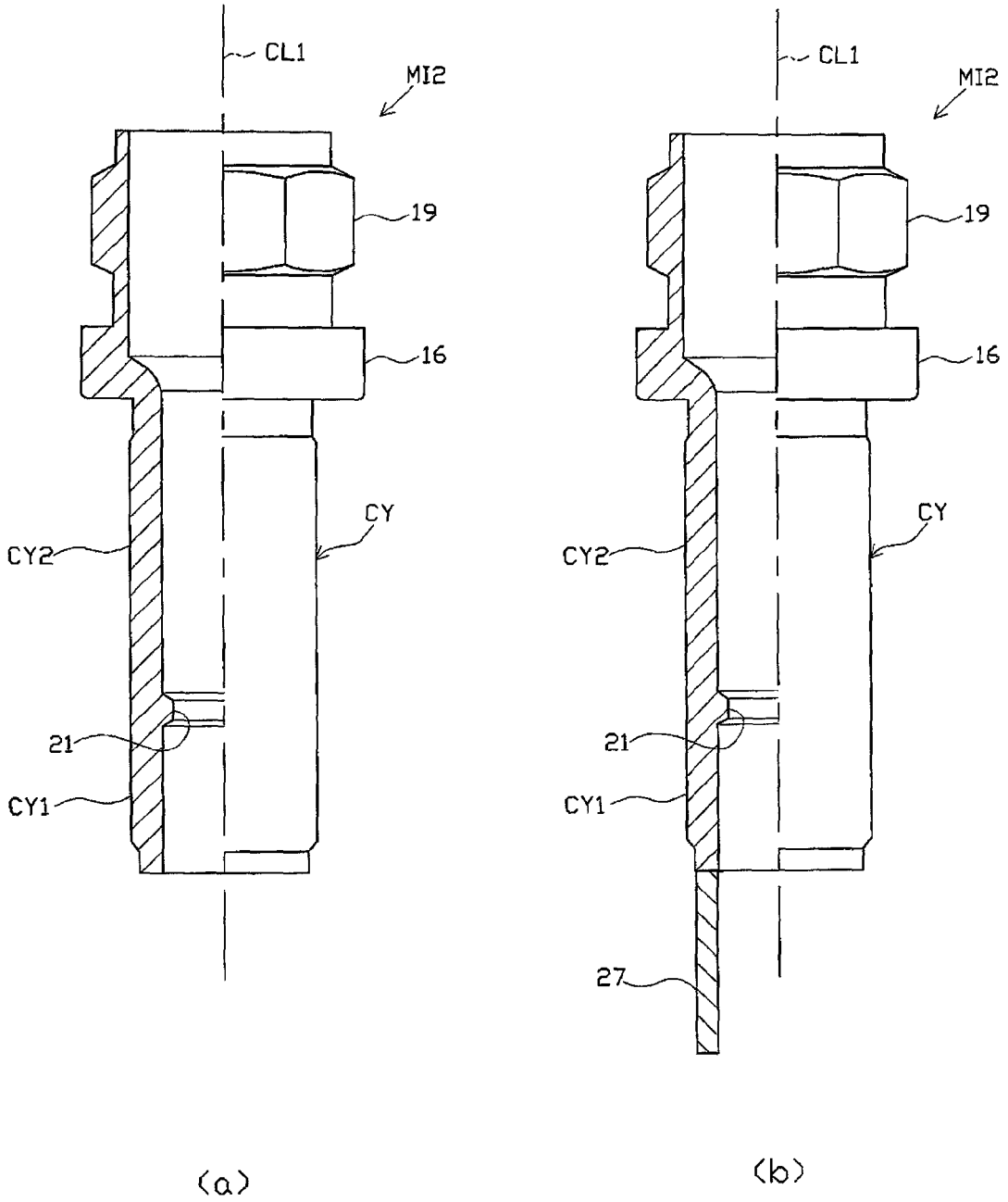
FIGS. 8(*a*) and 8(*b*) are partially cutaway front views respectively showing the configuration of a metallic shell tubular intermediate and the configuration of the metallic shell tubular intermediate to which a ground electrode is joined.

Subsequently, cutting work is performed on, for example, a forward end portion of the polygonal columnar portion MG and an inner circumferential surface located forward of the protrusion P4, thereby yielding, as shown in FIG. 8(*a*), a metallic shell tubular intermediate MI2 having a tubular form (i.e., having a tubular portion CY) and having the seat portion 16, the tool engagement portion 19, the elongated protrusion 21, etc.

The metallic shell tubular intermediate MI2 has a first tubular portion CY1 having a cylindrical form and extending forward from the forward end of the elongated protrusion 21 in the direction of the axial line CL1 and a second tubular portion CY2 having a cylindrical form and extending rearward from the rear end of the elongated protrusion 21 in the direction of the axial line CL1. The first tubular portion CY1 and the second tubular portion CY2 are greater in inside diameter than the elongated protrusion 21; as a result, a portion (i.e., the elongated protrusion 21) smaller in inside diameter than the first and second tubular portions CY1 and CY2 is formed between the first tubular portion CY1 and the second tubular portion CY2. The radial wall thickness of the first tubular portion CY1 and the radial wall thickness of the second tubular portion CY2 are relatively small (e.g., 5 mm or less).

Additionally, the inner circumferential surface of the first tubular portion CY1 is shaped by cutting work after the extrusion, and the inner circumferential surface of the second tubular portion CY2 is shaped by the extrusion. Therefore, the center axis of the inner circumferential surface of the first tubular portion CY1 and the center axis of the inner circumferential surface of the second tubular portion CY2 are apt to be radially offset from each other. A step of the extrusion and cutting work mentioned above corresponds to the "first tubular portion forming step" in the present invention, and a step of the extrusion corresponds to the "second tubular portion forming step" in the present invention.

In the present embodiment, the first tubular portion CY1 is a cylindrical portion extending forward from the forward end of the elongated protrusion 21 in the direction of the axial line CL1, and the second tubular portion CY2 is a cylindrical portion extending rearward from the rear end of the elongated protrusion 21 in the direction of the axial line CL1; however, the first tubular portion may be a tubular portion located at an end portion of the metallic shell tubular intermediate MI2, and the second tubular portion may be a tubular portion different from the first tubular portion. Therefore, for example, a forward end portion of the metallic shell tubular intermediate MI2 can be called the first tubular portion, and a portion from the rear end of the first tubular portion to the elongated protrusion 21 can be called the second tubular portion. That is, the first tubular portion is a tubular portion located at an end portion of the metallic shell tubular intermediate MI2, but is not particularly limited in range along its axial direction, whereas the second tubular portion may be a tubular portion of the metallic shell tubular intermediate MI2 other than the first tubular portion.

Returning back to the description of the manufacturing method, as shown in FIG. 8(*b*), the straight-rodlike ground electrode 27 is resistance-welded to a forward end portion of the yielded metallic shell tubular intermediate MI2. The resistance welding is accompanied by formation of so-called "sags,"; thus, after the "sags" are removed, in the rolling step, the threaded portion 15 is formed on that outer circumferential surface of the metallic shell tubular intermediate MI2 which ranges from the first tubular portion CY1 to the second tubular portion CY2.

Figure 9:
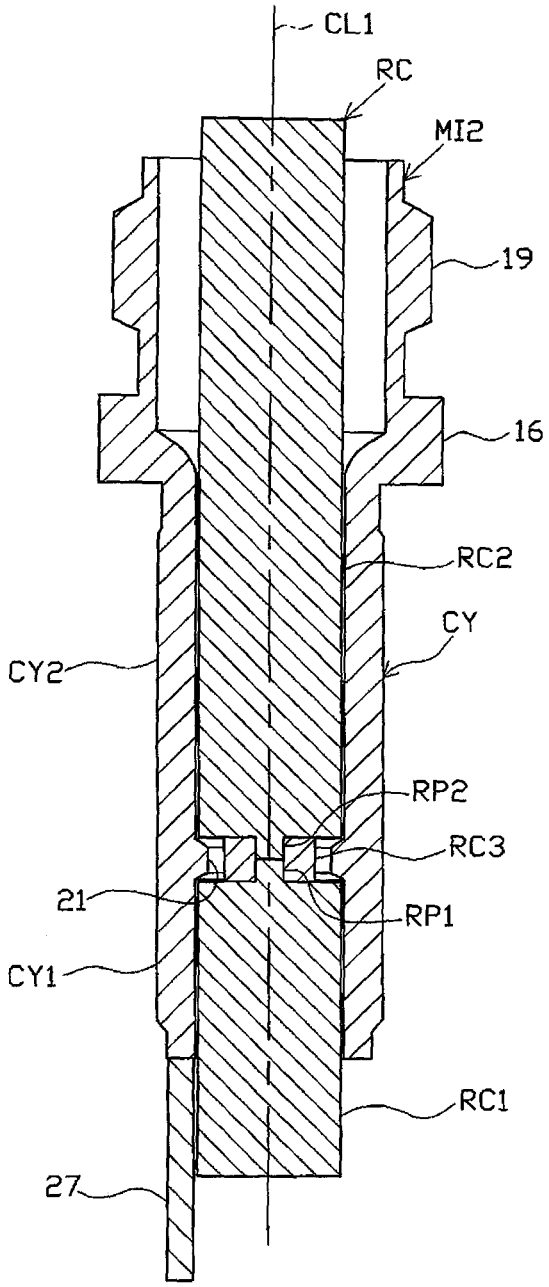
FIG. 9 is a sectional view showing a bearing member inserted into the metallic shell tubular intermediate.

In the rolling step, first, as shown in FIG. 9, a rodlike bearing member RC formed of a predetermined metal material [e.g., hardened steel (carbon steel) or tool steel] higher in hardness than the metallic shell tubular intermediate MI2 is inserted into the metallic shell tubular intermediate MI2. The bearing member RC is configured such that a first component RC1, an intermediate component RC3, and a second component RC2 which differ in outside diameter are sequentially connected in series with their center lines aligned with one another and such that the components RC1, RC2, and RC3 are separable from one another.

The first component RC1 has a solid, circular columnar form; its outer circumferential surface has a shape along the inner circumferential surface of the first tubular portion CY1; and the first component RC1 has a protrusion RP1 at its end portion. The second component RC2 has a solid, circular columnar form; its outer circumferential surface has a shape along the inner circumferential surface of the second tubular portion CY2; and the second component RC2 has a protrusion RP2 at its end portion. The intermediate component RC3 has a tubular form and allows the protrusions RP1 and RP2 of the first and second components RC1 and RC2, respectively, to butt against each other therein.

In insertion of the bearing member RC into the metallic shell tubular intermediate MI2, while the first component RC1 is inserted from the forward end of the metallic shell tubular intermediate MI2, the second component RC2 is inserted from the rear end of the metallic shell tubular intermediate MI2; before insertion of at least one of the two components RC1 and RC2, the intermediate component RC3 is disposed at the inner circumference of the elongated protrusion 21; thus, the components RC1, RC2, and RC3 are connected together in the interior of the metallic shell tubular intermediate MI2. For example, the bearing member RC can be inserted into the metallic shell tubular intermediate MI2 as follows: the intermediate component RC3 is separated from the second component RC2, and, while the first component RC1 to which the intermediate component RC3 is connected is inserted from the forward end of the metallic shell tubular intermediate MI2, the second component RC2 is inserted from the rear end of the metallic shell tubular intermediate MI2, thereby connecting the second component RC2 and the intermediate component RC3 together. In the present embodiment, in the section of the metallic shell tubular intermediate MI2 taken orthogonally to the axial line CL1, the diametral difference between the inside diameter of the metallic shell tubular intermediate MI2 and the outside diameter of the bearing member RC is 0.002 mm or more, so that the bearing member RC can be easily inserted into the metallic shell tubular intermediate MI2.

Figure 10:
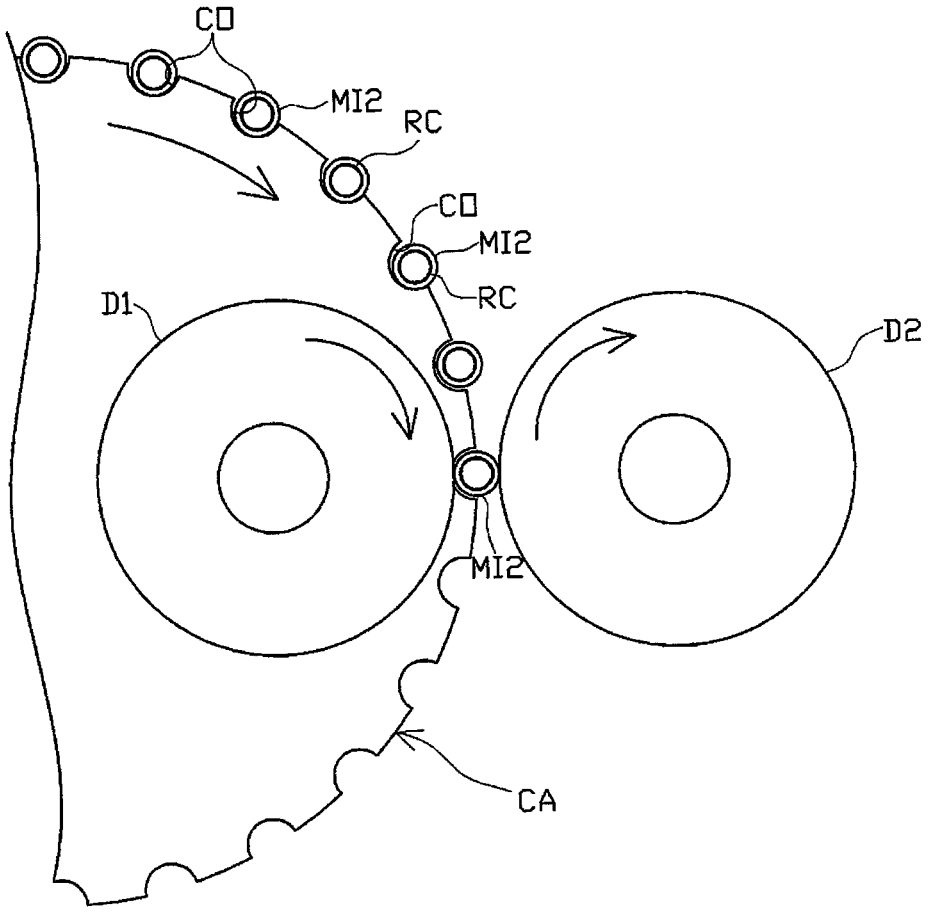
FIG. 10 is an enlarged front view showing how the metallic shell tubular intermediates are conveyed to rolling dies.

As shown in FIG. 10, by use of a rotary conveying apparatus CA having a plurality of cavities CO arranged on its outer circumferential surface intermittently along the circumferential direction, the metallic shell tubular intermediate MI2 into which the bearing member RC is inserted is disposed between the working surfaces of a plurality (in the present embodiment, a pair) of rolling dies D1 and D2. Specifically, in a state in which the metallic shell tubular intermediate MI2 is placed in the corresponding cavity CO, the rotary conveying apparatus CA is rotated in such a manner that its center axis serves as the axis of rotation, whereby the metallic shell tubular intermediate MI2 is disposed between the rolling dies D1 and D2.

Figure 11:
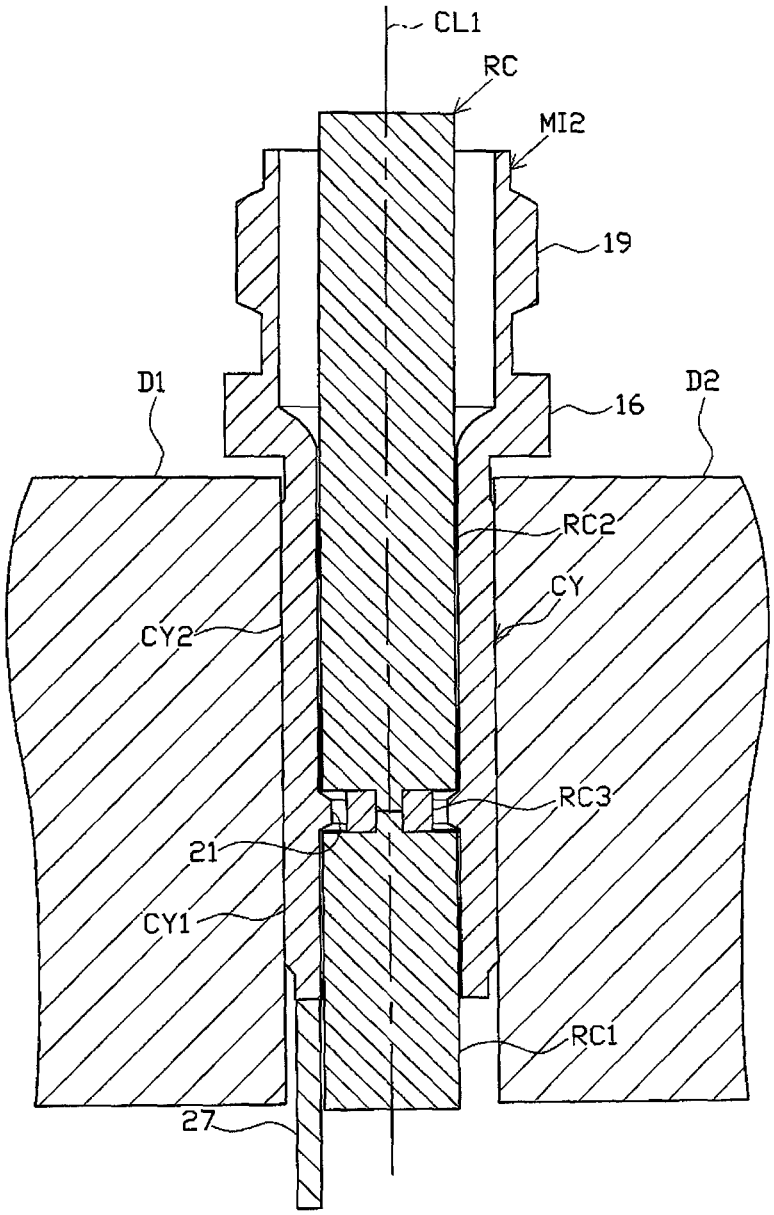
FIG. 11 is a sectional view showing one stage in a rolling step.
Figure 12:
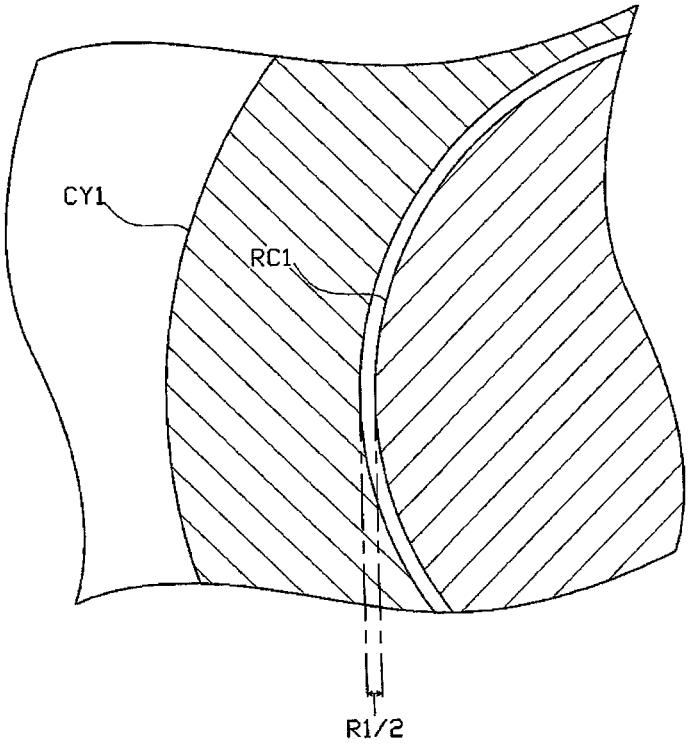
FIGS. 12(*a*) and 12(*b*) are partially enlarged sectional views respectively used for explaining the diametral difference between a first tubular portion and a first component, and for explaining the diametral difference between a second tubular portion and a second component.
Figure 12:
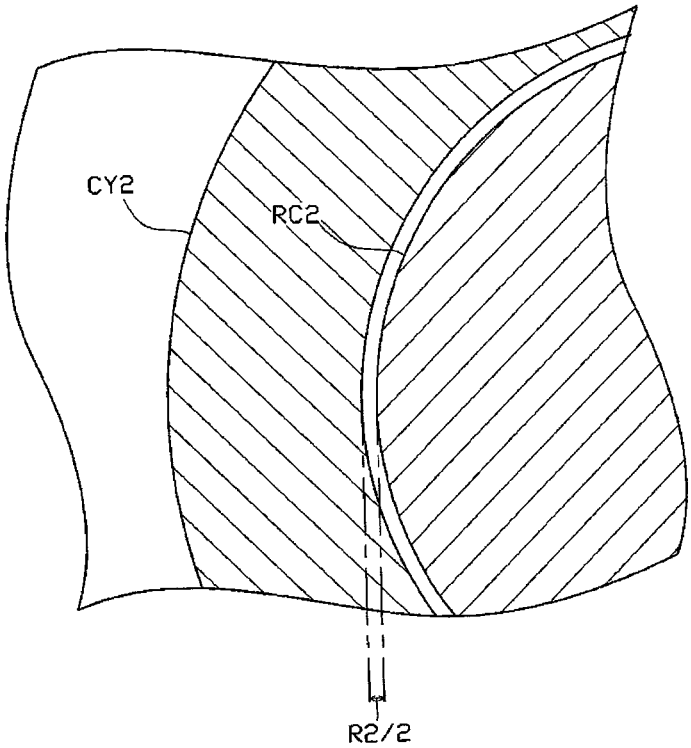

When the metallic shell tubular intermediate MI2 is disposed between the rolling dies D1 and D2, as shown in FIG. 11, rolling is performed on the metallic shell tubular intermediate MI2 as a result of rotation of the rolling dies D1 and D2. During rolling, the bearing member RC is not supported and is in a freely rotatable condition such that its center axis serves as the axis of rotation. As shown in FIG. 12(*a*), in the radial cross section of the first tubular portion CY1 of the metallic shell tubular intermediate MI2 into which the bearing member RC is inserted, a diametral difference R1 between the inside diameter of the metallic shell tubular intermediate MI2 (first tubular portion CY1) and the outside diameter of the bearing member RC (first component RC1) is 0.8 mm or less. Furthermore, as shown in FIG. 12(*b*), in the radial cross section of the second tubular portion CY2 of the metallic shell tubular intermediate MI2 into which the bearing member RC is inserted, a diametral difference R2 between the inside diameter of the metallic shell tubular intermediate MI2 (second tubular portion CY2) and the outside diameter of the bearing member RC (second component RC2) is 0.8 mm or less.

Figure 13:
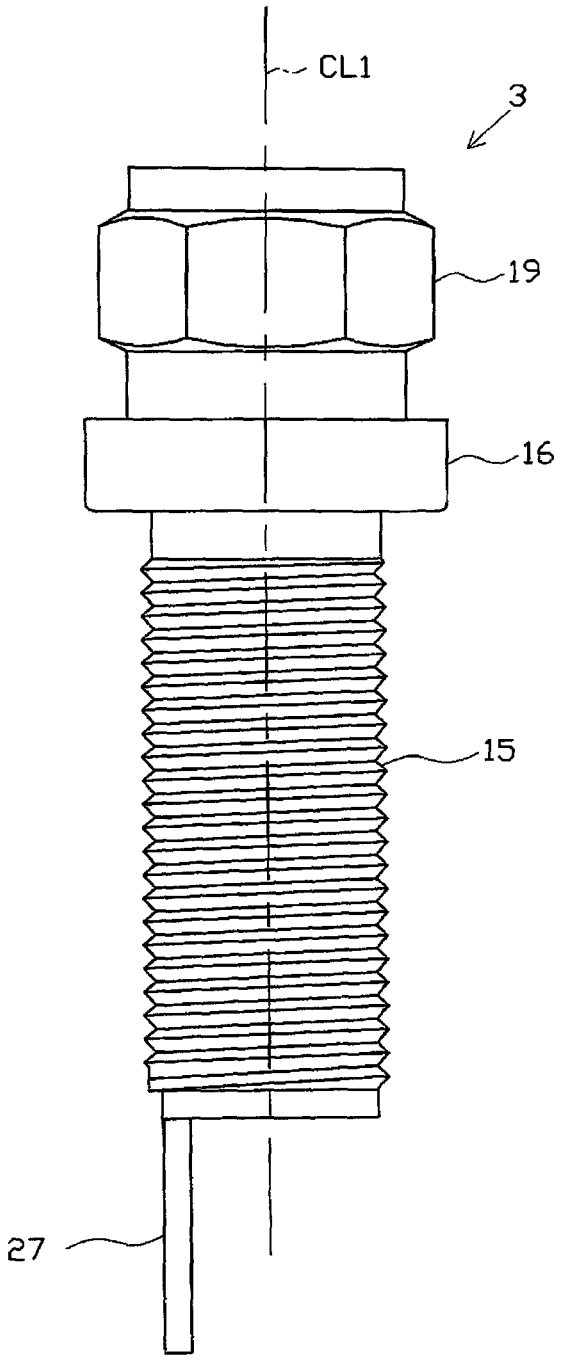
FIG. 13 is a front view showing the configuration of a metallic shell.

Additionally, in the rolling step, rolling is performed simultaneously on at least the first tubular portion CY1 and the second tubular portion CY2, whereby the threaded portion 15 is formed on the outer circumferential surfaces of the first and second tubular portions CY1 and CY2. As a result, as shown in FIG. 13, there is yielded the metallic shell 3 to which the ground electrode 27 is welded.

Next, galvanization or nickel plating is performed on the surface of the metallic shell 3. In order to improve corrosion resistance, the plated surface may be further subjected to chromate treatment.

Separately from preparation of the metallic shell 3, the ceramic insulator 2 is formed. For example, a forming material granular-substance is prepared by use of a material powder which contains alumina in a predominant amount, a binder, etc. By use of the prepared forming material granular-substance, a tubular green compact is formed by rubber press forming. The thus-formed green compact is subjected to grinding for shaping the external shape; then, the shaped green compact is fired, thereby yielding the ceramic insulator 2.

Separately from preparation of the metallic shell 3 and the ceramic insulator 2, the center electrode 5 is formed. Specifically, a Ni alloy in which a copper alloy or a like metal is disposed in a central region for improving heat radiation performance is subjected to forging, thereby yielding the center electrode 5.

Then, the ceramic insulator 2 and the center electrode 5, which are formed as mentioned above, the resistor 7, and the electrode terminal 6 are fixed in a sealed condition by means of the glass seal layers 8 and 9. In order to form the glass seal layers 8 and 9, generally, a mixture of borosilicate glass and a metal powder is prepared, and the prepared mixture is charged into the axial hole 4 of the ceramic insulator 2 such that the resistor 7 is sandwiched therebetween; subsequently, the resultant assembly is sintered, in a kiln, in a condition in which the charged mixture is pressed from the rear by the electrode terminal 6. At this time, a glaze layer may be simultaneously fired on the surface of the rear trunk portion 10 of the ceramic insulator 2; alternatively, the glaze layer may be formed beforehand.

Subsequently, the thus-formed ceramic insulator 2 having the center electrode 5 and the electrode terminal 6, and the thus-formed metallic shell 3 having the ground electrode 27 are assembled together. More specifically, in a condition in which the ceramic insulator 2 is inserted into the metallic shell 3, a relatively thin-walled rear-end opening portion of the metallic shell 3 is crimped radially inward; i.e., the crimped portion 20 is formed, thereby fixing the ceramic insulator 2 and the metallic shell 3 together.

Finally, a substantially intermediate portion of the ground electrode 27 is bent, and the dimension G of the spark discharge gap 28 is adjusted, thus yielding the ignition plug 1 mentioned above.

As described in detail above, according to the present embodiment, in a condition in which the bearing member RC is inserted into the metallic shell tubular intermediate MI2, rolling is performed on at least the first tubular portion CY1 and the second tubular portion CY2. Thus, in the rolling step, as a result of the outer circumferential surface of the metallic shell tubular intermediate MI2 being pressed by the rolling dies D1 and D2, particularly, a thick portion of the metallic shell tubular intermediate MI2 is deformed in a crushed manner while being nipped between the bearing member RC and the rolling dies D1 and D2. Accordingly, the inclinations of the inner circumferential surfaces of the first and second tubular portions CY1 and CY2 can be rectified, and correction can be made such that the center axis of the inner circumferential surface of the first tubular portion CY1 and the center axis of the inner circumferential surface of the second tubular portion CY2 coincide with the center axis of the bearing member RC. Therefore, as compared with a condition before the rolling step, the radial offset between the center axis of the first tubular portion CY1 and the center axis of the second tubular portion CY2 can be effectively reduced, and, in turn, in the ignition plug 1, the eccentricity between the center axis of a forward end portion of the metallic shell 3 and the center axis of a forward end portion of the center electrode 5 can be sufficiently reduced. As a result, the thread diameter of the threaded portion 15 is specified as MI2 or less; the screw reach L is specified as 20 mm or more; and the dimension G of the spark discharge gap 28 is specified as 0.4 mm or more. Through these specifications, the generation of abnormal discharge can be more reliably restrained in the ignition plug 1 in which abnormal discharge could otherwise be generated in occurrence of even some eccentricity between a forward end portion of the metallic shell 3 and a forward end portion of the center electrode 5.

Also, without need to employ additional working, rolling to be performed for forming the threaded portion 15 is utilized for reducing eccentricity between the center axis of the first tubular portion CY1 and the center axis of the second tubular portion CY2, whereby an increase in manufacturing cost can be restrained.

Furthermore, the diametral differences R1 and R2 between the inside diameter of the metallic shell tubular intermediate MI2 and the outside diameter of the bearing member RC are 0.8 mm or less in a radial cross section of the first tubular portion CY1 and in a radial cross section of the second tubular portion CY2, respectively. Therefore, in the rolling step, the metallic shell tubular intermediate MI2 is more reliably nipped between the bearing member RC and the rolling dies D1 and D2, so that the metallic shell tubular intermediate MI2 can be more reliably deformed. As a result, eccentricity between the two tubular portions CY1 and CY2 can be further reliably reduced.

Additionally, the bearing member RC is freely rotatable such that its center axis serves as an axis of rotation, so that in the rolling step, the bearing member RC is rotatable together with the metallic shell tubular intermediate MI2. Therefore, in the rolling step, friction force generated between the metallic shell tubular intermediate MI2 and the bearing member RC can be reduced to the greatest possible extent, and, in turn, there can be accelerated deformation of the metallic shell tubular intermediate MI2 resulting from nipping between the bearing member RC and the rolling dies D1 and D2. As a result, the eccentricity between the two tubular portions CY1 and CY2 can be more reliably reduced.

Next, in order to verify actions and effects to be yielded by the embodiment described above, there were manufactured a plurality of samples of the metallic shell tubular intermediate, and the samples were measured for a radial offset of the center axis of a portion of the metallic shell tubular intermediate located 3 mm rearward from the forward end of the metallic shell tubular intermediate (the portion corresponds to the second tubular portion) from the center axis of the forward end (corresponding to the first tubular portion) of the metallic shell tubular intermediate. Next, rolling was performed on the samples into which corresponding bearing members were inserted so as to form the threaded portion on the outer circumferential surfaces of the first and second tubular portions of the samples, and the offset of the axis after the rolling was measured. Table 1 shows the offsets of the axes of the samples before and after the rolling. The diametral differences R1 and R2 were set to 0.8 mm or less.

TABLE 1

| | Offset of axis (mm) | |
|---|---|---|
| Sample No. | Before rolling | After rolling |
| 1 | 0.07 | 0.03 |
| 2 | 0.06 | 0.04 |
| 3 | 0.04 | 0.02 |
| 4 | 0.03 | 0.02 |
| 5 | 0.08 | 0.05 |
| 6 | 0.07 | 0.04 |

TABLE 1-continued

| Sample No. | Offset of axis (mm) Before rolling | After rolling |
|---|---|---|
| 7 | 0.04 | 0.03 |
| 8 | 0.03 | 0.02 |
| 9 | 0.06 | 0.03 |
| 10 | 0.04 | 0.03 |
| 11 | 0.05 | 0.03 |
| 12 | 0.06 | 0.03 |

As is apparent from Table 1, through execution of rolling after insertion of the bearing member, as compared with a condition before the rolling, the offset between the center axis of the first tubular portion and the center axis of the second tubular portion can be reduced, whereby the eccentricity between the two tubular portions can be further reduced. Conceivably, this is for the following reason: in the rolling step, as a result of the outer circumferential surface of the metallic shell tubular intermediate being pressed by the rolling dies, particularly, a thick portion of the metallic shell tubular intermediate was deformed in a crushed manner while being nipped between the bearing member and the rolling dies; as a result, the inclination of the inner circumferential surface of the metallic shell tubular intermediate was rectified, and correction was made such that the center axis of the inner circumferential surface of the metallic shell tubular intermediate coincided with the center axis of the bearing member.

The present invention is not limited to the above-described embodiment, but may be embodied, for example, as follows. Of course, applications and modifications other than those exemplified below are also possible.

(a) In the embodiment described above, the threaded portion 15 has a thread diameter of M12 or less; however, the thread diameter of the threaded portion 15 is not particularly limited, but may exceed M12. Also, no particular limitation is imposed on the screw reach L and on the dimension G of the spark discharge gap 28. The screw reach L may be less than 20 mm, and the dimension G of the spark discharge gap 28 may be less than 0.4 mm.

Figure 14:
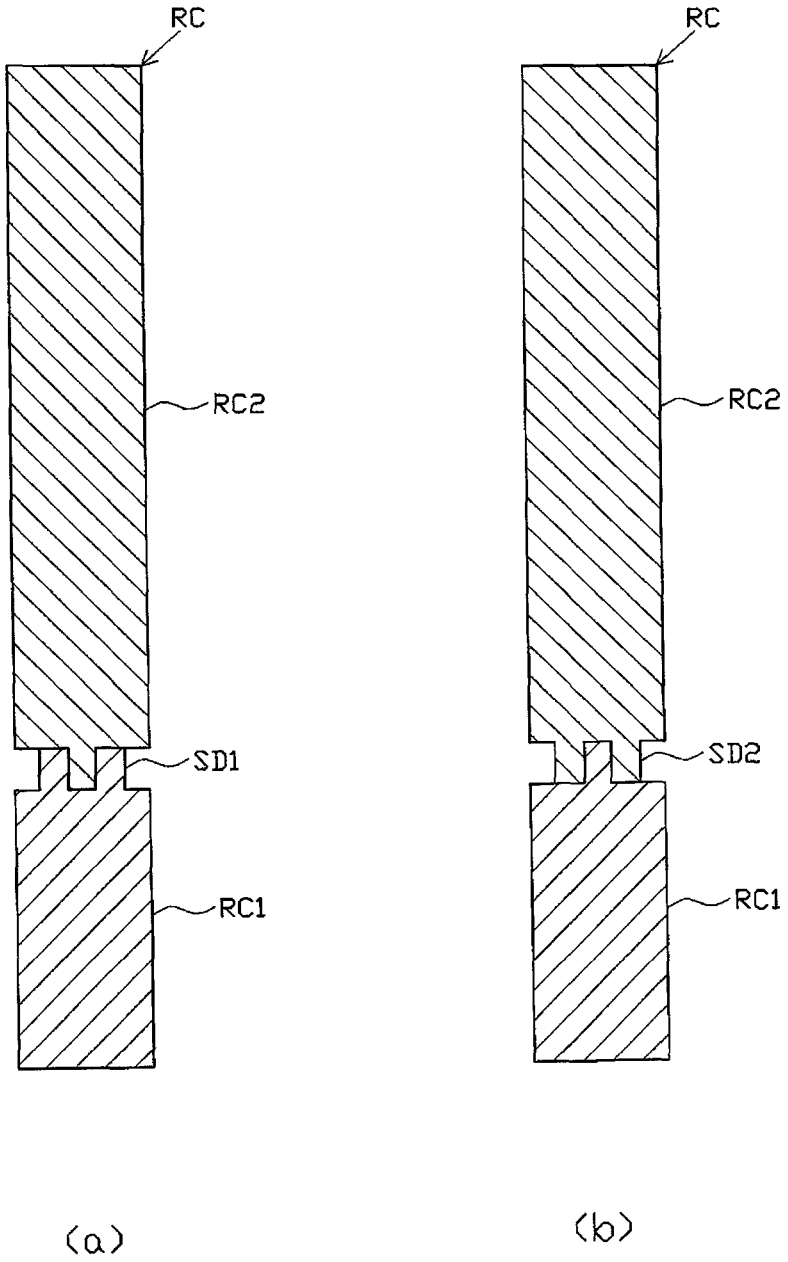
FIGS. 14(*a*) and 14(*b*) are sectional views showing the configurations of the bearing members in other embodiments.

(b) In the embodiment described above, the bearing member RC has the intermediate component RC3. However, as shown in FIGS. 14 (*a*) and (*b*), the intermediate component RC3 may be eliminated as follows: the first component RC1 or the second component RC2 has, at its end, a small-diameter portion SD1 or SD2 insertable into the inner circumference of the elongated protrusion 21. In this case, the following configuration may be employed: one of the two components RC1 and RC2 has a protrusion at its end portion; the other one of the two components RC1 and RC2 has, at its end portion, a hole portion into which the protrusion can be fitted; and the two components RC1 and RC2 can be connected together through engagement of the protrusion and the hole portion.

(c) In the embodiment described above, the bearing member RC is formed of a metal material; however, no particular limitation is imposed on material used to form the bearing member RC. For example, the bearing member RC may be formed of ceramic. Through use of ceramic to form the bearing member RC, in the rolling step, friction force generated between the metallic shell tubular intermediate MI2 and the outer circumferential surface of the bearing member RC can be further reduced. As a result, force to be radially applied from the bearing member RC to the metallic shell tubular intermediate MI2 can be increased, whereby the effect of correcting eccentricity can be further improved.

Figure 15:
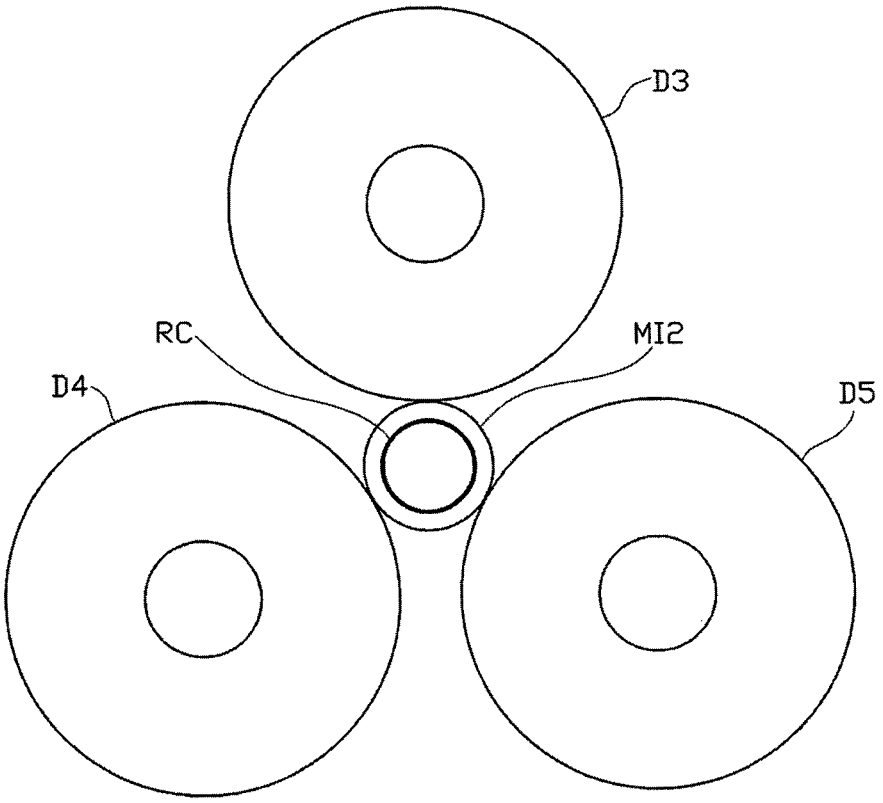
FIG. 15 is a plan view showing the configuration of rolling dies in another embodiment.

(d) In the embodiment described above, rolling is performed by use of a pair of the rolling dies D1 and D2; however, no particular limitation is imposed on the number of rolling dies. For example, as shown in FIG. 15, three rolling dies D3, D4, and D5 disposed such that their axes of rotation are equally spaced may be used for performing rolling on the metallic shell tubular intermediate MI2.

Figure 16:
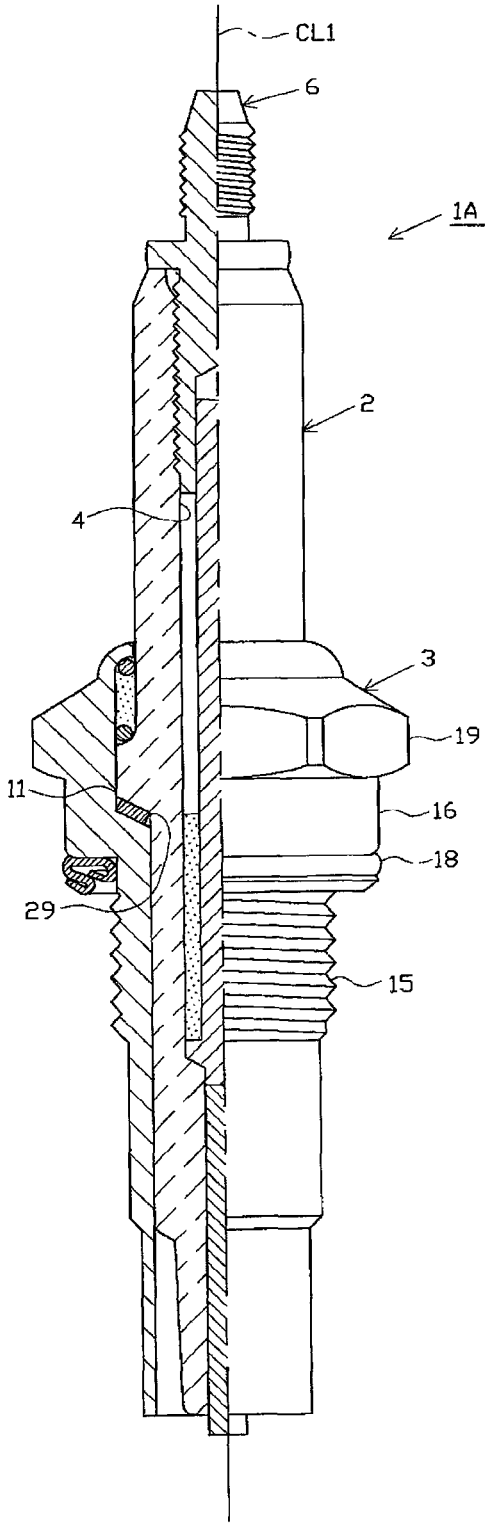
FIG. 16 is a partially cutaway front view showing the configuration of an ignition plug in another embodiment.

(e) In the embodiment described above, the metallic shell 3 has the elongated protrusion 21 on its inner circumferential surface, and the metallic shell tubular intermediate MI2 has, between the first and second tubular portions CY1 and CY2, a portion whose inside diameter is smaller than those of the two tubular portions CY1 and CY2. By contrast, as shown in FIG. 16, an ignition plug 1A may be configured such that the metallic shell 3 does not have the elongated protrusion 21 on its inner circumferential surface; instead, such that the large-diameter portion 11 of the ceramic insulator 2 is seated on a stepped portion 29 formed on the inner circumference of the seat portion 16 of the metallic shell 3.

(f) The metallic shell 3 which can be manufactured by use of the technical ideas of the present invention is not limited to that for use in an ignition plug which ignites an air-fuel mixture or the like through generation of spark discharge. For example, the technical ideas of the present invention may be used in manufacturing a metallic shell for use in a plasma jet ignition plug which ignites an air-fuel mixture or the like through generation of plasma.

(g) In the embodiment described above, the rotary conveying apparatus CA continuously conveys a plurality of the metallic shell tubular intermediates MI2 to a space between the rolling dies D1 and D2; however, no particular limitation is imposed on the method of disposing the metallic shell tubular intermediate MI2 between the rolling dies. Thus, the metallic shell tubular intermediate MI2 may be disposed between the rolling dies as follows: the metallic shell tubular intermediate MI2 is disposed before the rolling dies; then, either the metallic shell tubular intermediate MI2 or the rolling dies approach the other for disposing the metallic shell tubular intermediate MI2 between the rolling dies. Also, no particular limitation is imposed on timing when the bearing member RC is inserted into the metallic shell tubular intermediate MI2 so long as timing of insertion is before rolling.

DESCRIPTION OF REFERENCE NUMERALS

1: ignition plug; 2: ceramic insulator (insulator); 3: metallic shell (metallic shell for ignition plug); 5: center electrode; 15: threaded portion; 16: seat portion; 27: ground electrode; 28: gap (spark discharge gap); CL1: axial line; CY: tubular portion; CY1: first tubular portion; CY2: second tubular portion; D1, D2: rolling die; MI1: metallic shell intermediate; MI2: metallic shell tubular intermediate; RC: bearing member; RC1: first component; and RC2: second component.

The invention claimed is:

1. A method of manufacturing a metallic shell for an ignition plug, the metallic shell having a tubular shape, extending in a direction of an axial line, and having a threaded portion on its outer circumferential surface to be engaged with a mounting hole of a combustion apparatus, the method comprising:

a metallic shell tubular intermediate forming step of forming a metallic shell tubular intermediate by providing a tubular portion to a metallic shell intermediate that is to become the metallic shell for an ignition plug, and a rolling step of performing rolling on the metallic shell tubular intermediate using rolling dies to form the thread portion, wherein the metallic shell tubular intermediate forming step comprises the steps of:

forming a first tubular portion at an end portion of the metallic shell intermediate, and forming a second tubular portion at at least a portion of that region of the metallic shell intermediate which differs from the first tubular portion; and the rolling step comprises the steps of:

inserting a bearing member into the metallic shell tubular intermediate for nipping the metallic shell tubular intermediate in cooperation with working surfaces of the rolling dies;

rolling simultaneously at least the first tubular portion and the second tubular portion such that a post-rolling radial eccentricity between a center axis of the first tubular portion and a center axis of the second tubular portion becomes smaller than a pre-rolling radial eccentricity between the center axis of the first tubular portion and the center axis of the second tubular portion; and providing a diametral difference between an inside diameter of the metallic shell tubular intermediate and an outside diameter of the bearing member to be 0.8 mm or less in a radial cross sections of the first tubular portion and the second tubular portion.

2. The method of manufacturing a metallic shell for an ignition plug according to claim 1, wherein the bearing member has a rod shape and comprises;

a first component formed along an inner circumferential surface of the first tubular portion, and a second component formed along an inner circumferential surface of the second tubular portion.

3. The method of manufacturing a metallic shell for an ignition plug according to claim 1, wherein the metallic shell tubular intermediate has, between the first tubular portion and the second tubular portion, a portion having an inside diameter smaller than those of the first tubular portion and the second tubular portion.

4. The method of manufacturing a metallic shell for an ignition plug according to claim 1, wherein the threaded portion has a thread diameter of M12 or less.

5. The method of manufacturing a metallic shell for an ignition plug according to claim 1, wherein the metallic shell for an ignition plug is such that its length along the direction of the axial line is greater than its outside diameter.

6. The method of manufacturing a metallic shell for an ignition plug according to claim 1, wherein the metallic shell has a seat portion protruding radially outward from its outer circumferential surface and a length along the axial line from a forward end of the metallic shell to the seat portion of the metallic shell is 20 mm or more.

7. The method of manufacturing a metallic shell for an ignition plug according to claim 1, wherein the bearing member is freely rotatable such that its center axis serves as an axis of rotation.

8. The method of manufacturing an ignition plug comprising the method of manufacturing a metallic shell for an ignition plug according to claim 1.

9. The method of manufacturing an ignition plug according to claim 8, wherein the ignition plug comprises:

a tubular insulator disposed along an inner circumference of the metallic shell for the ignition plug, a center electrode disposed along an inner circumference of the insulator, and a ground electrode disposed at a forward end portion of the metallic shell for the ignition plug and forming a gap in cooperation with a forward end portion of the center electrode, the gap being in a range of 0.4 mm or more.

* * * * *